US005887758A

United States Patent [19]

Hawkes et al.

[11] Patent Number: 5,887,758

[45] Date of Patent: Mar. 30, 1999

[54] ICE ACCESS AND DISCHARGE SYSTEM

[75] Inventors: Richard Blair Hawkes, Bethlehem; Dale Stanley Berger, Nazareth, both of Pa.

[73] Assignee: Follett Corporation, Easton, Pa.

[21] Appl. No.: 769,600

[22] Filed: Dec. 18, 1996

[51] Int. Cl.[6] ..... B67D 5/62; B67D 3/00; B65D 47/00

[52] U.S. Cl. ..... 222/146.6; 222/561; 222/564; 222/547

[58] Field of Search ..... 222/146.6, 561, 222/564, 547

[56] References Cited

U.S. PATENT DOCUMENTS

| | | | |
|---|---|---|---|
| 3,436,928 | 4/1969 | Swerbinsky | 62/137 |
| 3,744,270 | 7/1973 | Wilcox | 62/344 |
| 4,176,528 | 12/1979 | Frohbieter | 62/344 |
| 4,555,049 | 11/1985 | Mawby, et al. | 222/517 |
| 4,632,280 | 12/1986 | Mawby, et al. | 222/275 |
| 4,903,866 | 2/1990 | Loew | 222/129 |
| 5,088,300 | 2/1992 | Wessa | 62/340 |
| 5,105,981 | 4/1992 | Gehman | 222/1 |
| 5,105,991 | 4/1992 | Johnson | 222/185.1 |
| 5,211,030 | 5/1993 | Jameson | 62/344 |
| 5,279,445 | 1/1994 | Fisher, et al. | 222/146.6 |
| 5,293,757 | 3/1994 | Nishio | 222/146.6 |
| 5,375,413 | 12/1994 | Fredell, et al. | 62/187 |
| 5,437,393 | 8/1995 | Blicher, et al. | 222/185.1 |
| 5,730,333 | 3/1998 | Baluk, et al. | 222/561 |

*Primary Examiner*—Andres Kashnikow
*Assistant Examiner*—Keats Quinalty
*Attorney, Agent, or Firm*—Paul & Paul

[57] ABSTRACT

An ice access and discharge apparatus for an ice bin including an access opening for access to ice in the bin and a slidably disposed ice baffle for baffling ice within the bin away from the access opening and metering ice flow to an ice discharge spout and to provide ice on a first in-first out basis. The ice discharge spout has a slidably disposed ice discharge gate for manually metering ice into an ice container.

21 Claims, 5 Drawing Sheets

ICE ACCESS AND DISCHARGE SYSTEM

FIELD OF THE INVENTION

The present invention relates to an ice storage bin apparatus for use with commercial ice making equipment. More particularly, the invention relates to an apparatus in which an improved ice removal system is provided in which ice is delivered to containers through a delivery spout with a metering gate. Proper baffling is achieved within the ice bin to provide metering of ice to the delivery spout and to provide a "first in-first out" flow of ice, but which also provides a simple and adequate means to gain additional access to the ice for shoveling, agitation, and the like.

BACKGROUND OF THE INVENTION

Ice has long been provided to meet various commercial demands. Generally, sizable quantities of particulate ice are stored within a bin to facilitate the availability of ice so that an appropriate amount of ice needed in a given instance may be removed from the bin. Once ice has been made, whether as ice shavings, cubes, cylinders, or the like, such particles usually reside in the holding bin until dispensed.

Removal of ice from upright bins has traditionally been performed by either hand scooping or shoveling from the bin. It is preferable for ice to be delivered to containers on a first in, first out basis. This feature, however, typically requires that the ice access area be low, near the bottom of the ice bin, which yields a less than optimum removal height, particularly for scooping. When the bin is full and the ice access area is near the bottom of the ice bin, a baffle is required to keep the ice from pouring out of the ice access area when the ice bin is full.

A difficulty with such a baffle is that it limits access for shoveling and ice agitation, ice bridge breaking, and the like. To resolve this problem, one prior baffle means uses a hinged ice check door, which is hinged at the top of the ice access area, which swings from a locked position inside the ice bin, where baffling occurs, out such that additional ice access is achieved. If there is ice filling the ice access area, interference between the ice check door and the ice occurs, making returning the door to the locked position, where proper baffling is achieved, very difficult. An object of the present invention eliminates this difficulty by using a baffle that slides into place through the ice, rather than a baffle that rotates.

The present invention provides a new and improved ice bin, having an ice access and discharge apparatus in which ice is delivered via gravity from the ice bin through an ice discharge chute having a discharge gate. The baffle provides for metering of the ice to the ice discharge spout as well as providing for ice to be delivered on a first in-first out basis.

The principal object of the ice discharge apparatus of the present invention provides improved means for removing ice from a conventional up-right ice bin, a better method of maintaining and controlling ice flow in the bin, and a simple, cost effective means for transporting ice in confined areas.

SUMMARY OF THE INVENTION

This invention relates generally to ice storage bins. More particularly, the present invention relates to an ice bin with an improved ice access and discharge apparatus.

The filling of an ice tote, bucket, receptacle or other container is achieved by positioning the ice container directly below a spout funnel. This can be accomplished by either placing the container on the floor under the spout or by wheeling it into place on a cart. When one of the containers is positioned, the spout gate is operated to fill the container. When filled, a second container can be positioned for filling. Depending on the spout configuration, any number of transport containers can be filled by the present ice dispensing apparatus.

The present invention is directed to an ice access and discharge apparatus for an ice bin. The apparatus includes an access opening for access to ice in the bin, a slidably disposed ice baffle located in the ice bin at the upper end of the access opening for baffling ice within the bin away from the access opening and metering ice flow to an ice discharge spout and to provide ice on a first in-first out basis. The ice discharge spout, located below the lower end of the access opening, has a slidably disposed ice discharge gate for manually metering ice into an ice container.

It is accordingly an object of the present invention to provide a new and improved ice bin having a novel ice access and discharge apparatus.

It is another object of the present invention to provide a new and improved ice bin having a novel ice access and discharge apparatus with a ice delivery spout with a gate for delivering a desired amount of ice.

It is another object of the present invention to provide a new and improved ice bin having a novel ice access and discharge apparatus with a slidably disposed ice baffle which may be set in a plurality of positions for allowing access to ice in the bin, while providing proper baffling such that ice may be delivered to an ice delivery spout at a regulated level and ice may be retrieved from the bin on a first in-first out basis.

It is a further object of the present invention to provide a new and improved ice bin having a novel ice access and discharge apparatus with an ice discharge spout with a slidably disposed ice discharge gate that provides means for metering a desired amount of ice through the spout by sliding the gate to provide a desired ice discharge opening.

Another object of the present invention is to provide a combination discharge spout and baffle that accurately meters ice from an ice bin into containers Another object of the present invention is to provide a quick and efficient means and method of transferring ice delivered through the delivery spout from an ice bin to one or more ice containers.

A further object of the present invention is to provide a system that removes ice from an ice bin which substantially eliminates the need for scooping or shoveling ice out of the ice bin, by dispensing ice from an ice bin into one or more containers on a cart which allows for quick and efficient means and method of transferring ice from an ice bin to the containers located on the cart.

Other objects and advantages of the present invention will become apparent from the following description taken in conjunction with the accompanying drawings.

DESCRIPTION OF THE PREFERRED EMBODIMENT

Figure 1:
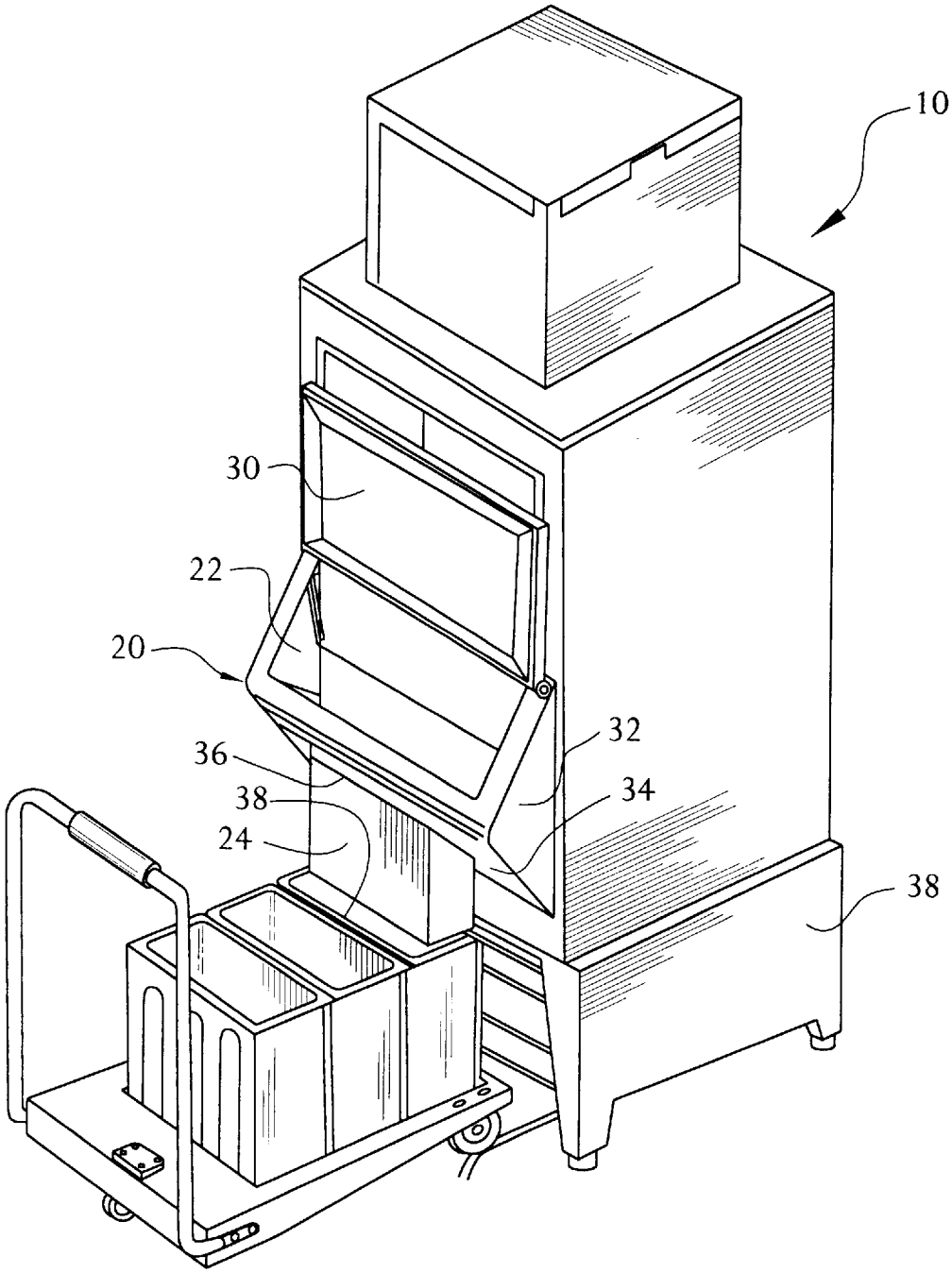
FIG. 1 is a perspective view of an ice bin having an ice access and discharge apparatus embodying the present invention.
Figure 3:
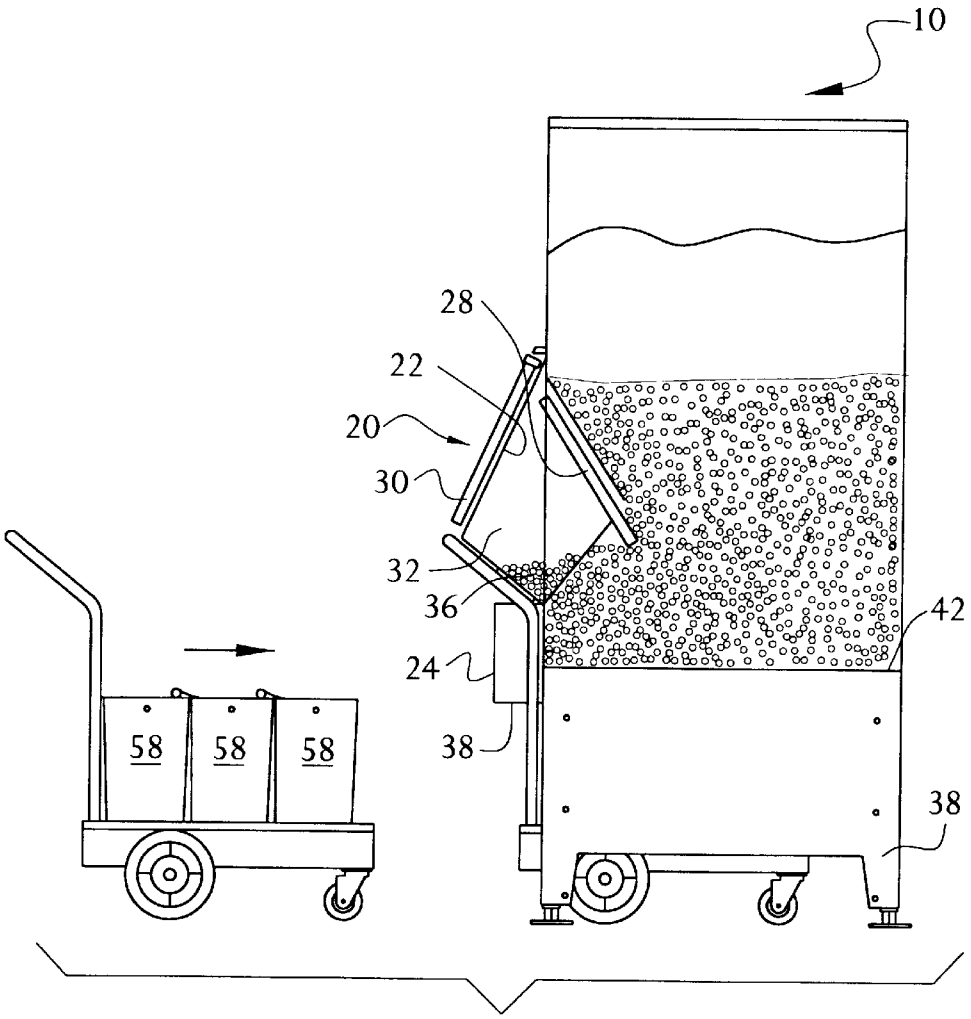
FIG. 3 is a side view of the ice bin, partially cutaway, having the ice access and discharge apparatus of FIG. 1 and depicting an ice cart having ice containers.
Figure 2:
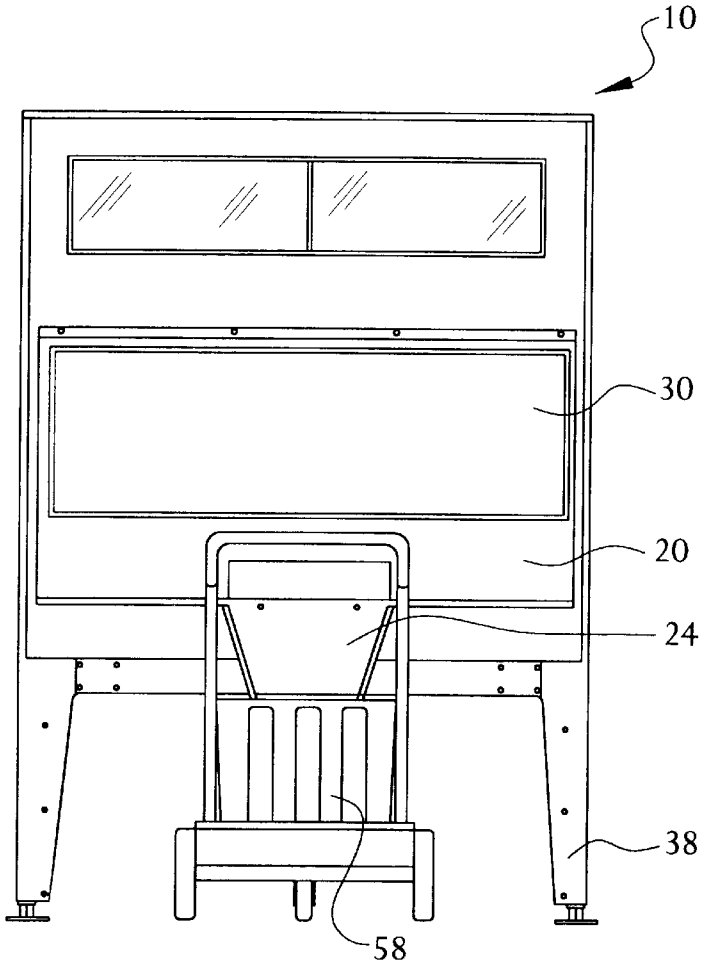
FIG. 2 is a front view of the ice bin having an ice access and discharge apparatus of FIG. 1.

Referring now in detail to the drawings, wherein like reference numerals indicate like elements throughout the several views, there is shown in FIGS. 1, 2, and 3 an ice storage bin 10 having an ice access and discharge apparatus 20 in accordance with one preferred embodiment of the present invention.

Figure 4:
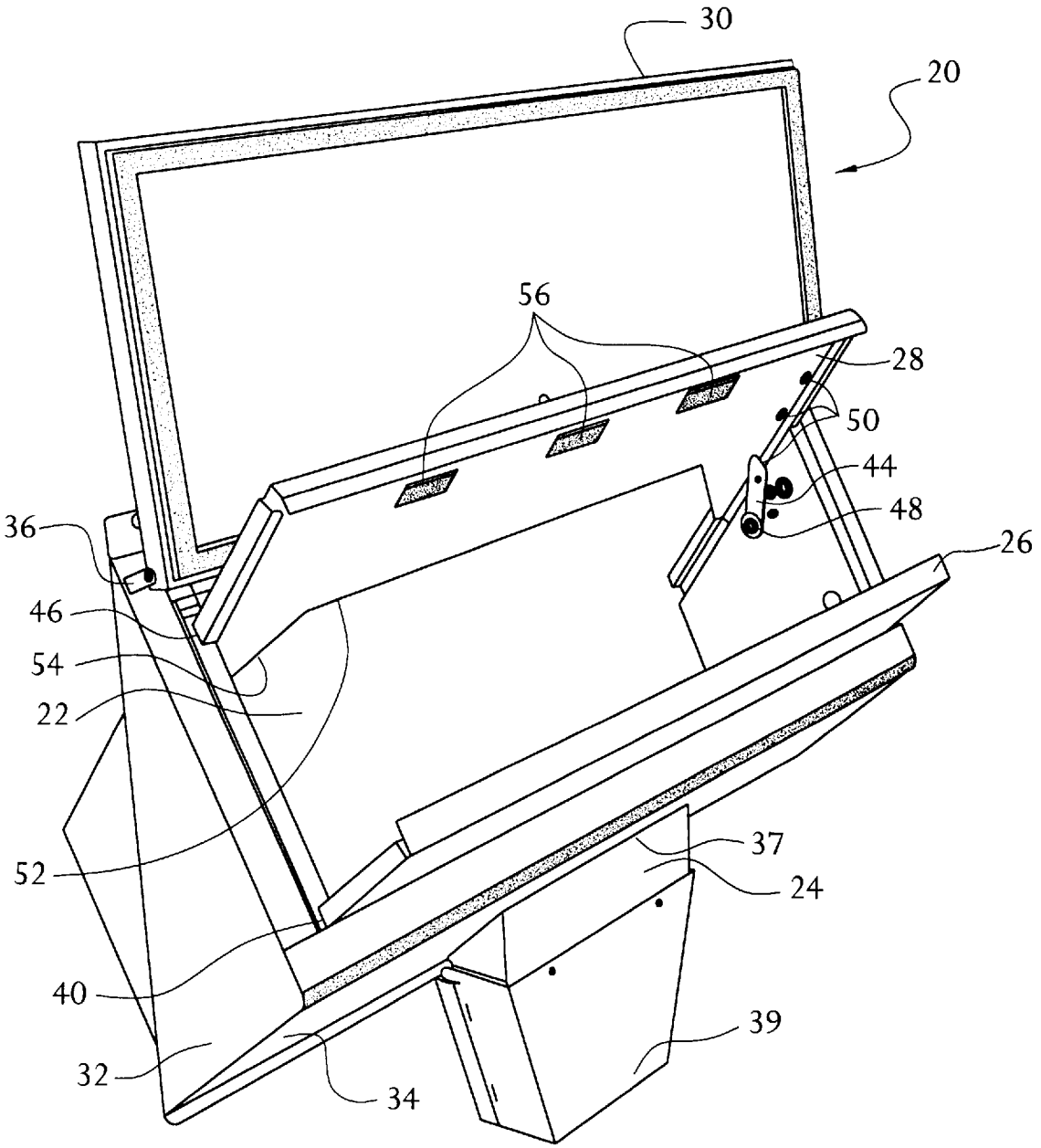
FIG. 4 is a perspective view of the ice access and discharge apparatus the ice bin of FIG. 1.
Figure 5:
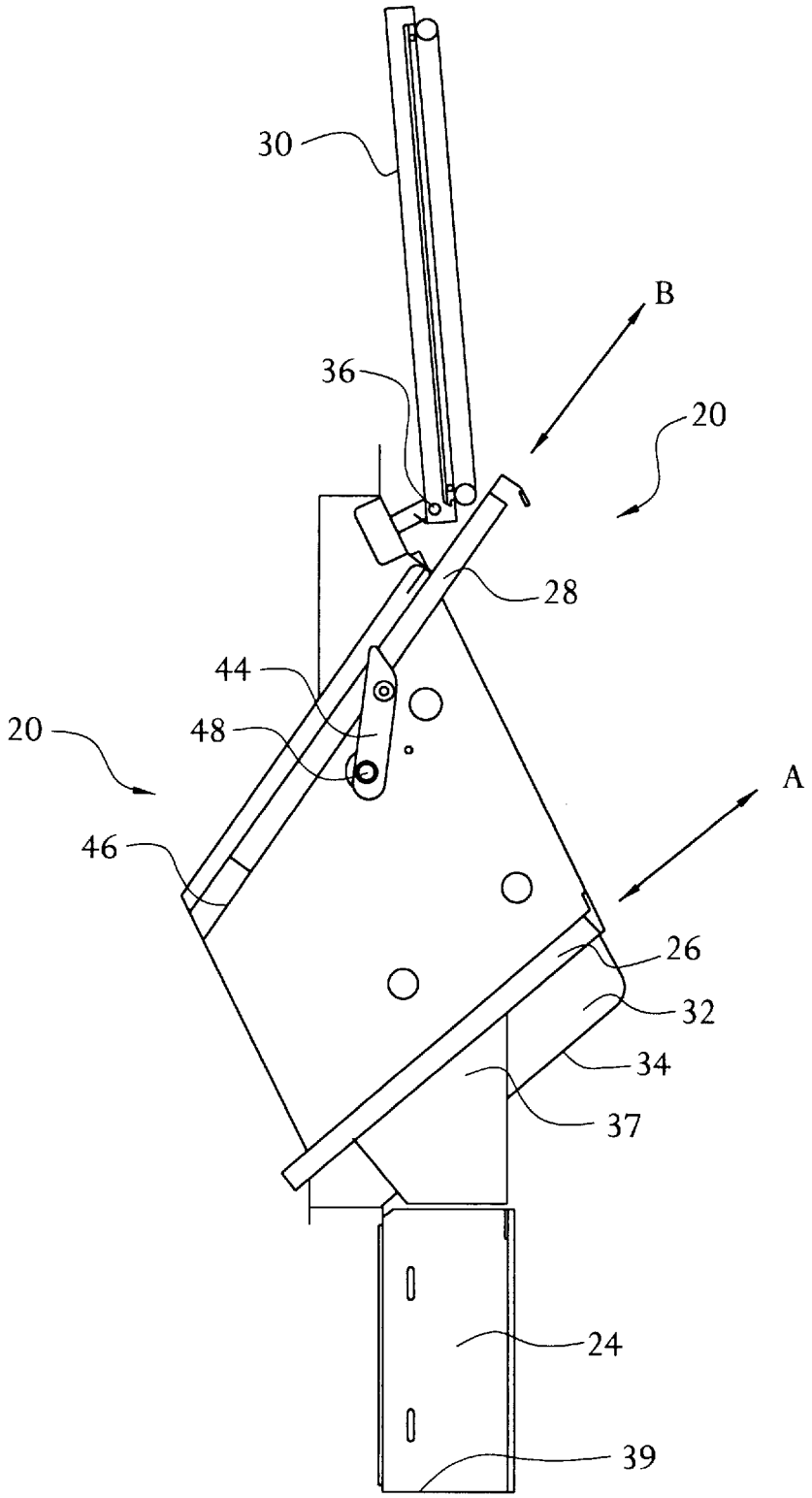
FIG. 5 is a side cross-sectional view of the ice access and discharge apparatus, as depicted in FIG. 4.

As more clearly depicted in FIGS. 4 and 5, one preferred embodiment of the ice access and discharge apparatus 20 has an access opening 22, an ice discharge spout 24 having a slidably disposed ice discharge gate 26, a slidably disposed ice baffle 28, and a door 30 for sealing the access opening 22 when ice delivery is not desired.

In this preferred embodiment, the ice access and discharge apparatus 20, as coupled to the ice storage bin 10, forms a snout 32 that protrudes from the ice storage bin 10. On the front surface of the snout 32 is the access opening 22 formed on an angle to the vertical such that easy access to the interior of the ice bin 10 may be obtained by reaching down and in. Further, located adjacent to the lower surface 34 of the snout 32 that protrudes from the ice bin 10, is the ice discharge spout 24.

The access opening 22 is preferably generally rectangular in shape with an upper end and a lower end, and has a door 30 which acts to prevent the outside air from entering the ice bin 10 to avoid melting of the ice and prevent contaminants from entering the bin 10. The door 30 is hinged by hinges 36 along the top of the access opening 22 such that the door 30 swings in an upward and outward direction enabling full access to the ice bin access opening 22. The access opening 22 is preferably located near the bottom of the ice bin 10 such that ice from the bottom of the bin may be dispensed prior to new ice added to the ice bin 10 from above; i.e. ice is dispensed on a first in-first out basis. To aid a person desiring ice, the entire ice bin 10 is preferably raised on legs 38 or a stand such that the bottom of the ice discharge spout 24 is at a suitable height for filling containers 58 of ice. See FIGS. 1–3. Additionally, the raised height of the ice bin allows for easier shoveling of ice directly from the access opening 22 to a container 58.

As is clearly depicted in FIGS. 1 and 4, the ice discharge spout 24 is on the lower end of the snout 32, beneath the door 30. The discharge spout 24 is open to the interior of the ice bin 10 at the spout's 24 upper end 37 and, at its lower end 39 is also open. As seen in the cutaway view, FIG. 3, the discharge spout 24 is located such that ice flowing through the bin 10, around the baffle 28, arrives at the upper end 37 of the discharge spout 24. However, the slidably disposed ice discharge gate 26 (see FIGS. 4 and 5), when at its fully inserted position (see FIG. 5) prevents ice from flowing down through the ice discharge spout 24. The ice discharge gate 26 is slidable in tracks 40 such that as the discharge gate 26 is retracted in direction A (see FIG. 5), more and more ice is metered out through the discharge spout 24. When a desired amount of ice is distributed through the ice discharge spout 24, the ice discharge gate 26 may then be pushed in to the fully inserted position (see FIG. 5) such that ice no longer flows through the discharge spout 24.

The ice baffle 28 is provided such that ice entering from the top of the ice bin 10 is diverted around the ice access opening 22. As can be seen in the cutaway view of the bin 10, FIG. 3, this baffle 28 provides the proper flow of ice to the ice discharge spout 24 and aids in achieving the first in-first out flow of ice. As can be seen, newly added ice to the bin is deflected around baffle 28 such that ice removed from the ice bin 10 is ice that is in the lower portion of the bin 10.

However, it is desirable that the baffle 28 be movable such that substantially full access to the interior of the ice bin 10 through the ice access opening 22 is available. That is, it is desirable that the ice baffle 28 be movable such that the baffle 28 may be positioned such that substantially no baffling of ice occurs. This may be required, for example, when only a small amount of ice remains in the ice bin 10, or, when withdrawal of ice only through the access opening 22 is desired.

Additionally, it may be desirable to control ice flow to the ice discharge spout 24. Therefore, the baffle 28 preferably slides in and out (direction B) as shown in FIG. 5, from a fully inserted position (see FIG. 3), where maximum baffling occurs, to a fully retracted position (see FIG. 4), where a minimum, or no baffling occurs. Between these fully inserted and fully retracted positions, the baffle should be latchable in a plurality of positions such that the needed ice flow to the ice discharge spout 24 is achieved.

Depending upon various factors, including whether or not access to ice through both the ice access opening 22 and the ice discharge spout 24 is desired, the temperature inside the ice bin 10, and the amount of ice in the ice bin 10, the various positions in which the baffle 28 may be positioned provides for precise flow of ice to the ice discharge spout 24.

The ice baffle 28 is preferably slidably disposed adjacent the upper edge of the access opening 22. As described above, the ice baffle 28 preferably slides in tracks from a fully inserted position in which the ice baffle is situated in a position angled down from the top edge of the access opening 22 generally back and towards the rear corner 42 of the ice bin 10 (see FIG. 3).

The ice baffle latching means for holding the ice baffle 28 in the plurality of different positions may be a simple mechanical latch 44 as clearly depicted in FIGS. 4 and 5. As can be seen here, the baffle 28 is positioned along track 46 until its approximate desired position is reached. The latch 44 is then pivoted around pivot point 48, to hook one of a plurality of slots 50 in the baffle 28, and thereby be locked in position.

As can be seen in FIG. 4, the baffle 28 may be shaped such that there is U-shaped cutout 52 at its rear edge which allows for increased ice access when the baffle 28 is in an inserted position, but also provides for complete withdrawal of the baffle when the baffle 28 is in a fully retracted position by providing additional slots 50 in which the baffle 28 may be latched. Additionally, the sides 54 of the cutout 52 aid in directing ice from the bin 10 towards the ice discharge spout 24.

Occasionally, it may be necessary to agitate the ice to loosen up frozen clumps of ice particles such that proper flow of ice through ice bin 10 to the ice discharge spout 24 is achieved. When the baffle 28 is at or near the fully inserted position, access to the ice within the ice bin 10 for manual agitation is limited. When agitation of the ice is required, to avoid the necessity of sliding the ice baffle out to the retracted position, as depicted in FIG. 4, small probe access ports 56 may be provided for manual ice agitation with an ice probe.

Optionally, the baffle 28 may be used alone, on a system having the ice access opening 22, but no ice discharge spout 24.

In use, an ice bin 10 full of ice is provided along with the ice access and discharge apparatus 20 of the present invention. A container 58 in which ice is desired to be placed is then located under the ice discharge spout 24. The door 30 to the ice bin 10 is opened and ice is allowed to flow through the spout by the withdrawal of the ice discharge gate. If a proper amount of ice is not flowing through the spout 24, the baffle 28 may be repositioned to provide decreased baffling, such that more ice may flow through the discharge spout 24 to the container 58. If ice is still not flowing freely through the system, ice bridges or clumps of ice may be broken up by either using an ice probe through only the ice access opening 22 after withdrawing the ice baffle, if necessary, or through the probe access ports 56. Alternatively, ice may be scooped or shoveled in the traditional manner through the access opening 22, or to the ice delivery spout 24 with or without withdrawal of the baffle 28.

Figure 6:
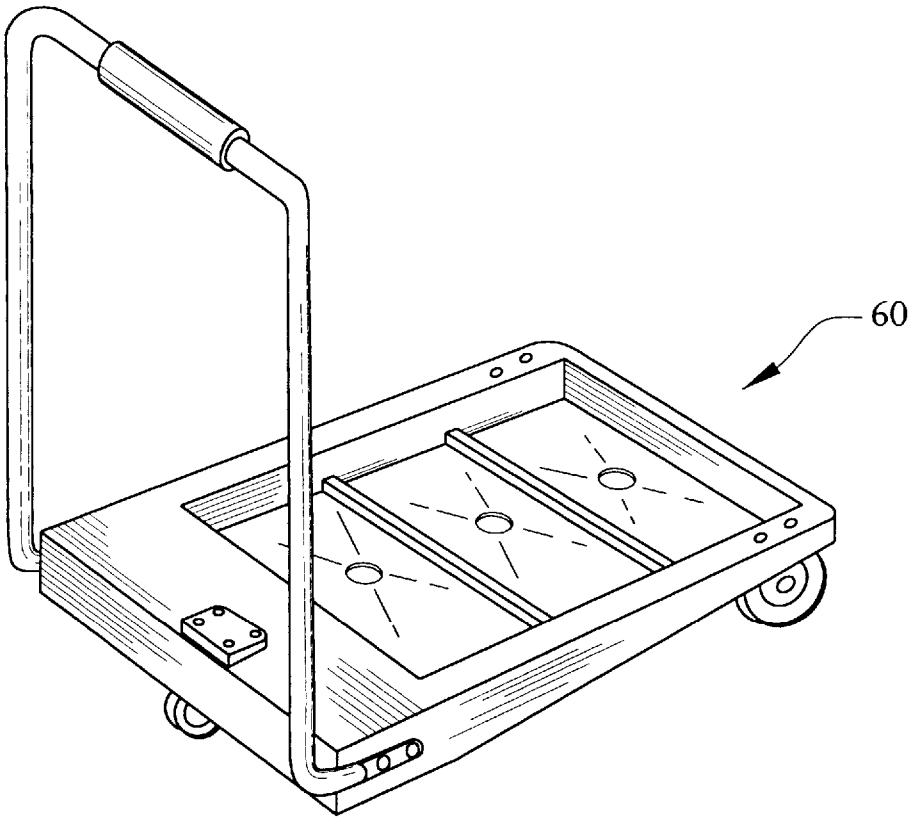
FIG. 6 is a perspective view of the ice cart of FIG. 3.

It is typically required that ice flowing out of the ice bin 10 flow into a container 58. An added advantage of the structure of the present invention is that it allows for a unique manner of distributing ice to a plurality of containers 58. As depicted in FIGS. 1 and 3, one or more containers 58 may be placed on a wheeled cart 60. See FIG. 6. The cart 60 is then positioned such that one container 58 is positioned under the discharge spout 24 and ice is metered into the container 58 through the discharge spout 24 by retracting the ice discharge gate 26. When the first container 58 is filled to the desired level, the ice discharge gate is fully inserted to the closed position and the cart 60 is repositioned such that a second container 58 is positioned directly under the ice discharge spout 24 and ice is then again metered in to this container 58. These steps are repeated until all containers on the cart 60 are filled. Using a cart 60 with a plurality of containers 58 in this manner with the ice access and discharge apparatus 20 of the present invention allows for extremely quick and efficient loading of ice into containers 58, eliminating the need for shoveling or scooping ice out of the ice bin 10 as is required by prior art systems.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

We claim:

1. An ice access and discharge apparatus for an ice bin comprising:

a. an access opening to allow a user of the ice access and discharge apparatus unobstructed access to ice in said bin, said access opening having an upper end and a lower end; and b. a slidably disposed ice baffle at said upper end of said access opening for baffling ice within said bin away from said access opening for aiding in providing ice on a first in-first out basis and controlling ice flow within said bin.

2. The ice access and discharge apparatus of claim 1, wherein the ice baffle has a latch means for holding the slidably disposed baffle in a plurality of positions.

3. An ice access and discharge apparatus for an ice bin comprising:

a. an access opening for access to ice in said bin, said access opening having an upper end and a lower end; and b. a slidably disposed ice baffle at said upper end of said access opening for baffling ice within said bin away from said access opening for aiding in providing ice on a first in-first out basis and controlling ice flow within said bin, wherein the ice baffle slides on tracks adjacent to the access opening.

4. An ice access and discharge apparatus for an ice bin comprising:

a. an access opening for access to ice in said bin said access opening having an upper end and a lower end; and b. a slidably disposed ice baffle at said upper end of said access opening for baffling ice within said bin away from said access opening for aiding in providing ice on a first in-first out basis and controlling ice flow within said bin, wherein the baffle contains probe access ports for agitating ice.

5. An ice access and discharge apparatus for an ice bin comprising:

a. an access opening to allow a user of the ice access and discharge apparatus unobstructed access to ice in said bin, said access opening having an upper end and a lower end;

b. an ice baffle at said upper end of said access opening for baffling ice within said bin away from said access opening for aiding in providing ice on a first in-first out basis and controlling ice flow within said bin; and c. an ice discharge spout, located below said lower end of said access opening, having an ice discharge gate for metering ice into an ice container.

6. An ice access and discharge apparatus for an ice bin comprising:

a. an access opening for access to ice in said bin, said access opening having an upper end and a lower end;

b. an ice baffle at said upper end of said access opening for baffling ice within said bin away from said access opening for aiding in providing ice on a first in-first out basis and controlling ice flow within said bin; and c. an ice discharge spout, located below said lower end of said access opening, having an ice discharge gate for metering ice into an ice container, wherein the ice discharge gate is slidably disposed on tracks.

7. An ice access and discharge apparatus for an ice bin comprising:

a. an access opening for access to ice in said bin, said access opening having an upper end and a lower end;

b. an ice baffle at said upper end of said access opening for baffling ice within said bin away from said access opening for aiding in providing ice on a first in-first out basis and controlling ice flow within said bin; and c. an ice discharge spout, located below said lower end of said access opening, having an ice discharge gate for metering ice into an ice container, wherein the baffle contains probe access ports for agitating ice.

8. The ice access and discharge apparatus of claim 5, wherein the ice discharge spout is elevated to allow ice to flow from the spout to containers on a wheeled cart.

9. The ice access and discharge apparatus of claim 8, wherein the cart has means to carry a plurality of containers and wherein the ice access and discharge apparatus has means to deliver ice from the ice bin to each container successively by repositioning the cart under the spout until all containers on the cart are filled with ice.

10. An ice access and discharge apparatus for an ice bin comprising:

a. an access opening to allow a user of the ice access and discharge apparatus unobstructed access to ice in said bin, said access opening having an upper end and a lower end;

b. a slidably disposed ice baffle at said upper end of said access opening for baffling ice within said bin away from said access opening for aiding in providing ice on a first in-first out basis and controlling ice flow within said bin; and c. an ice discharge spout, located below said lower end of said access opening, having an ice discharge gate for metering ice into an ice container.

11. The ice access and discharge apparatus of claim 10, wherein the ice baffle has a latch means for holding the slidably disposed baffle in a plurality of positions.

12. An ice access and discharge apparatus for an ice bin comprising:

a. an access opening for access to ice in said bin, said access opening having an upper end and a lower end;

b. a slidably disposed ice baffle at said upper end of said access opening for baffling ice within said bin away from said access opening for aiding in providing ice on a first in-first out basis and controlling ice flow within said bin; and c. an ice discharge spout, located below said lower end of said access opening, having an ice discharge gate for metering ice into an ice container, wherein the ice baffle slides on tracks adjacent to the access opening.

13. An ice access and discharge apparatus for an ice bin comprising:

a. an access opening for access to ice in said bin, said access opening having an upper end and a lower end;

b. a slidably disposed ice baffle at said upper end of said access opening for baffling ice within said bin away from said access opening for aiding in providing ice on a first in-first out basis and controlling ice flow within said bin; and c. an ice discharge spout, located below said lower end of said access opening, having an ice discharge gate for metering ice into an ice container, wherein the baffle contains probe access ports for agitating ice.

14. The ice access and discharge apparatus of claim 10, wherein the ice discharge spout is elevated to allow ice to flow from the spout to containers on a wheeled cart.

15. The ice access and discharge apparatus of claim 14, wherein the cart has means to carry a plurality of containers and wherein the ice access and discharge apparatus has means to deliver ice from the ice bin to each container successively by repositioning the cart under the spout until all containers on the cart are filled with ice.

16. An ice access and discharge apparatus for an ice bin comprising:

a. an access opening to allow a user of the ice access and discharge apparatus unobstructed access to ice in said bin, said access opening having an upper end and a lower end;

b. a slidably disposed ice baffle at said upper end of said access opening for baffling ice within said bin away from said access opening for aiding in providing ice on a first in-first out basis and controlling ice flow within said bin; and c. an ice discharge spout, located below said lower end of said access opening, having a slidably disposed ice discharge gate for manually metering ice into an ice container.

17. The ice access and discharge apparatus of claim 16, wherein the ice baffle has a latch means for holding the slidably disposed baffle in a plurality of positions.

18. An ice access and discharge apparatus for an ice bin comprising:

a. an access opening for access to ice in said bin, said access opening having an upper end and a lower end;

b. a slidably disposed ice baffle at said upper end of said access opening for baffling ice within said bin away from said access opening for aiding in providing ice on a first in-first out basis and controlling ice flow within said bin; and c. an ice discharge spout, located below said lower end of said access opening. having a slidably disposed ice discharge gate for manually metering ice into an ice container, wherein the ice baffle slides on tracks adjacent to the access opening.

19. An ice access and discharge apparatus for an ice bin comprising:

a. an access opening for access to ice in said bin, said access opening having an upper end and a lower end;

b. a slidably disposed ice baffle at said upper end of said access opening for baffling ice within said bin away from said access opening for aiding in providing ice on a first in-first out basis and controlling ice flow within said bin; and c. an ice discharge spout, located below said lower end of said access opening, having a slidably disposed ice discharge gate for manually metering ice into an ice container, wherein the baffle contains probe access ports for agitating ice.

20. The ice access and discharge apparatus of claim 16, wherein the ice discharge spout is elevated to allow ice to flow from the spout to containers on a wheeled cart.

21. The ice access and discharge apparatus of claim 20, wherein the cart has means to carry a plurality of containers and wherein the ice access and discharge apparatus has means to deliver ice from the ice bin to each container successively by repositioning the cart under the spout until all containers on the cart are filled with ice.

* * * * *